US009691261B2

(12) United States Patent
Tuck et al.

(10) Patent No.: US 9,691,261 B2
(45) Date of Patent: Jun. 27, 2017

(54) HOME AUTOMATION COMMUNICATIONS

(71) Applicant: EchoStar Technologies International Corporation, Englewood, CO (US)

(72) Inventors: Frederick Tuck, Dunwoody, GA (US); David B. Lett, Duluth, GA (US); George Horkan Smith, Atlanta, GA (US); Mark Wayne Lea, Kennesaw, GA (US)

(73) Assignee: EchoStar Technologies International Corporation, Englewood, CO (US)

( * ) Notice: Subject to any disclaimer, the term of this patent is extended or adjusted under 35 U.S.C. 154(b) by 0 days.

(21) Appl. No.: 14/738,157

(22) Filed: Jun. 12, 2015

(65) Prior Publication Data

US 2016/0364976 A1 Dec. 15, 2016

(51) Int. Cl.
*G08B 25/14* (2006.01)
*G08B 27/00* (2006.01)

(52) U.S. Cl.
CPC ..... *G08B 25/14* (2013.01); *G08B 27/00* (2013.01)

(58) Field of Classification Search
CPC .... G08B 26/00; G08B 26/004; G08B 26/007; G08B 25/005; G08B 25/00; G08B 25/001; G08B 25/014
See application file for complete search history.

(56) References Cited

U.S. PATENT DOCUMENTS

2014/0320282 A1* 10/2014 Zhang ..... G08B 7/066 340/502
2015/0194044 A1* 7/2015 Adams ..... G08B 21/0269 340/539.13

* cited by examiner

*Primary Examiner* — Hongmin Fan
(74) *Attorney, Agent, or Firm* — Bejin Bieneman PLC

(57) ABSTRACT

A system includes a computing device programmed to receive an alert signal indicating an issue associated with a customer premises. The computing device is further programmed to transmit a notification signal to a plurality of remote devices, determine whether at least one of the plurality of remote devices has responded to the notification signal, and transmit an update signal to the other of the plurality of remote devices after one of the plurality of remote devices has responded to the notification. The update signal indicates that one of the plurality of remote devices has responded to the notification signal.

20 Claims, 4 Drawing Sheets

HOME AUTOMATION COMMUNICATIONS

BACKGROUND

So-called home automation systems generally include sensors, cameras, and the like that provide data to a computing device such as a central controller. The central controller may then provide information relating to events, the environment, and so forth, in a building such as a home. For example, a home automation system may detect temperature conditions, moisture conditions, smoke and/or fire conditions, possible break-ins, etc. In some instances a home automation system may be configured to automatically request emergency services upon detecting certain conditions, e.g., to call "911" emergency services or the like upon detecting a fire, possible break-in, etc. In other instances, some or all conditions reported by a home automation system may require a user decision and action to request emergency services. When a user is present in a building, apartment, suite, etc. that includes a home automation system, the user can act on information from the home automation system as appropriate to seek emergency services, e.g., by dialing an emergency service, e.g., a "911" service.

DETAILED DESCRIPTION

Some home automation systems can send alerts to a remote device, such as a cell phone, when an emergency situation is suspected at a customer premises. The user of the remote device can confirm the emergency situation by calling a home automation service provider and indicate whether to dispatch the police, fire department, or other emergency service to the customer premises. In some instances, the alert may be sent to multiple users via each user's remote device. After one of the users responds via, e.g., a user input provided to the remote device, the home automation system may notify the other users that someone has responded.

An example home automation system that notifies users when a potential emergency situation is being addressed includes a computing device programmed to receive an alert signal indicating an issue associated with a customer premises. The computing device is further programmed to transmit a notification signal to multiple remote devices, determine whether at least one of the remote devices has responded to the notification signal, and transmit an update signal to the other remote devices. The update signal indicates that a response to the alert signal has been received via one of the remote devices.

By sending the alert signal to multiple users, the example home automation system may increase the likelihood that at least one user can confirm the emergency situation before the police, fire department, or another emergency service is dispatched to the customer premises. Moreover, because the home automation system sends the update signal after one of the users responds, the home automation service provider is less likely to receive multiple calls concerning the same emergency situation.

The elements shown may take many different forms and include multiple and/or alternate components and facilities. The example components illustrated are not intended to be limiting. Indeed, additional or alternative components and/or implementations may be used.

Figure 1:
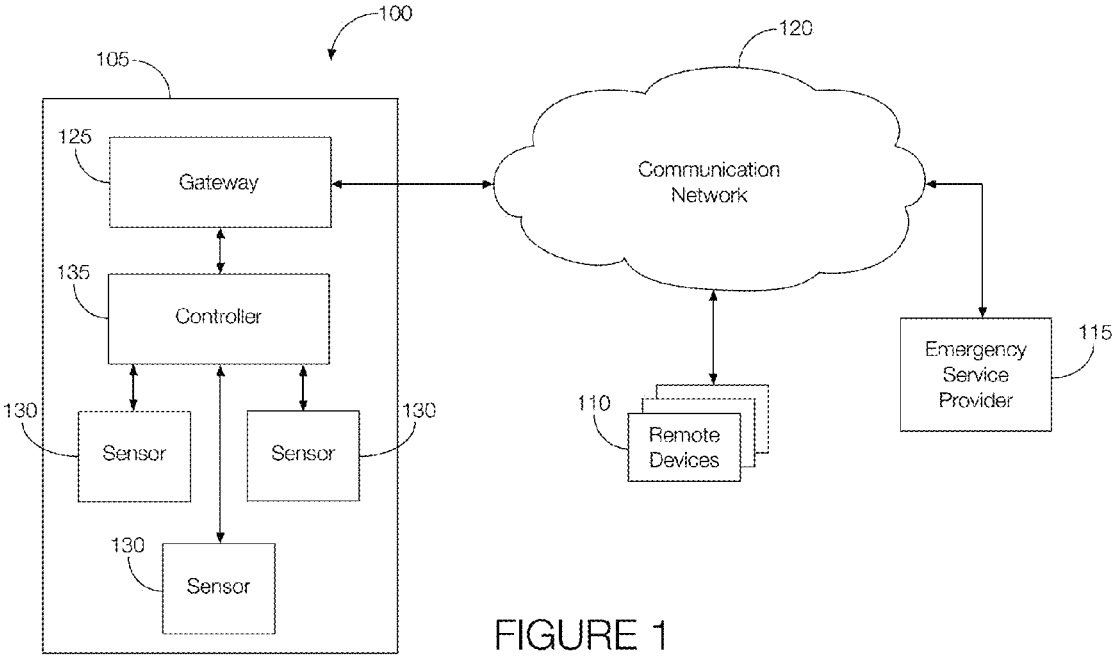
FIG. 1 is a block diagram of an example home automation system that can communicate with multiple remote devices.

As illustrated in FIG. 1, a home automation system 100 located at a customer premises 105 may be in communication with multiple remote devices 110 and an emergency service provider 115 over a communication network 120. The home automation system 100 may include a gateway 125, at least one sensor 130, and a controller 135.

The gateway 125 may be programmed to facilitate communication with the remote device 110 over the communication network 120. For instance, the gateway 125 may be programmed to transmit and receive signals with various wired or wireless communication protocols such as WiFi®, Bluetooth®, a satellite communication protocol, a cellular-based communication protocol, or the like.

The sensors 130 may include any electronic device programmed to detect and output alert signals representing a potential emergency situation associated with the customer premises 105. Examples of a potential emergency situation may include a potential break-in, a potential fire, a potential carbon monoxide leak, a potential gas leak, etc. The sensor 130, therefore, may include a camera, a motion sensor, a proximity sensor, a smoke detector, a glass-break sensor, a carbon monoxide detector, or the like. When a potential emergency situation is detected, the sensor 130 may output a corresponding alert signal representing the potential emergency situation. The alert signal may be output to, e.g., the controller 135 the communication network 120 and in accordance with a wired or wireless communication protocol.

The controller 135 may include any electronic computing device programmed to receive and process alert signals generated by the sensors 130. The controller 135 may process the alert signal to identify an issue associated with the customer premises 105. The issue may include, e.g., the potential emergency situation detected by the sensor 130. The controller 135 may be further programmed to transmit a notification signal to one or more remote devices 110 via the gateway 125. The controller 135 may wirelessly transmit the notification signal to any number of remote devices 110 associated with the customer premises 105. The notification signal may be transmitted wirelessly over, e.g., the communication network 120 and in accordance with any number of communication protocols. The remote devices 110 may become associated with the customer premises 105 via a registration process, as discussed in greater detail below. After a user of one of the remote devices 110 (i.e., the "responding remote device 110") has responded to the notification signal, the controller 135 may wirelessly transmit an update signal to the other remote devices 110 (i.e., the "non-responding remote devices 110") associated with the customer premises 105. The update signal may indicate that another user has already responded to the notification signal.

By way of example, if two remote devices 110 are registered for the customer premises 105, the notification signal may be transmitted to the both remote devices 110 after a potential emergency situation is detected. After one of the remote devices 110 responds, the controller 135 may transmit the update signal to the non-responding remote device 110. Thus, the chance of someone seeing and responding to the potential emergency situation is increased because multiple remote devices 110 received the notification signal. The emergency service provider 115 or home automation monitoring service, however, need not field multiple calls concerning the same potential emergency situation because the update signal instructed the user of the non-responding remote device 110 that the user of the responding remote device 110 had already responded and that no additional response was necessary.

The controller 135 may be programmed to determine that a user of one of the remote devices 110 that received the notification signal has already responded to the notification signal based on, e.g., a user input provided to the responding remote device 110. The user input may include a user pressing a real or virtual button on the responding remote device 110. The button may confirm or deny that the potential emergency situation exists. Alternatively, the user input may include the user pressing one or more real or virtual buttons to place a telephone call so the user can verbally confirm or deny whether the potential emergency situation exists to a representative of an emergency service provider 115 or home monitoring service. Further, if the emergency situation is confirmed, the user input may include an instruction to contact an emergency service provider 115 that can respond to the emergency situation. If the emergency situation does not exist (e.g., a false alarm), the user input may include an instruction to ignore the purported emergency situation.

Providing the user input may cause the remote device 110 to wirelessly transmit an acknowledgement signal to the controller 135 over the communication network 120 and in accordance with any number of communication protocols. The controller 135 may be programmed to generate and transmit the update signal to the non-responding remote devices 110 in response to receiving the acknowledgement signal.

Figure 2:
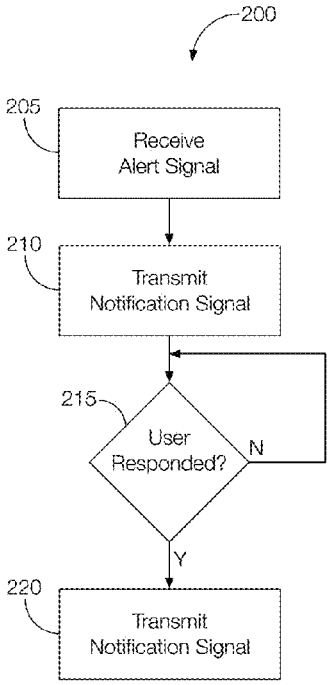
FIG. 2 is a diagram of an example process for communicating an alert signal to multiple remote devices.

FIG. 2 is a diagram of an example process 200 for communicating an alert signal to multiple remote devices 110 and for updating the non-responding remote devices 110 after one of the remote devices 110 responds to the alert signal.

At block 205, the controller 135 may receive an alert signal indicating an issue associated with a customer premises 105. The alert signal may represent a potential emergency situation associated with the customer premises 105. Examples of a potential emergency situation may include a potential break-in, a potential fire, a potential carbon monoxide leak, a potential gas leak, etc. The alert signal may be generated and output by a sensor 130 such as a camera, a motion sensor, a proximity sensor, a smoke detector, a glass-break sensor, a carbon monoxide detector, or the like.

At block 210, the controller 135 may generate and transmit a notification signal to the registered remote devices 110. The notification signal may be wirelessly transmitted over the communication network 120 and in accordance with any number of communication protocols.

At decision block 215, the controller 135 may determine whether a user of one of the registered remote devices 110 has responded to the notification signal. Whether a user of one of the registered remote devices 110 has responded may be based on a user input provided to the responding remote device 110. The user input may include a user pressing a real or virtual button on the responding remote device 110, which may cause the responding remote device 110 to transmit an acknowledgement signal to the controller 135. The user input may confirm or deny that the potential emergency situation exists. Alternatively or in addition, the user input may include the user pressing one or more real or virtual buttons to place a telephone call so the user can verbally confirm or deny whether the potential emergency situation exists to a representative of an emergency service provider 115. Further, if the emergency situation is confirmed, the user input may include an instruction to contact an emergency service provider 115 that can respond to the emergency situation. If the emergency situation does not exist (e.g., a false alarm), the user input may include an instruction to ignore the purported emergency situation. If the controller 135 determines that one of the users has already responded, the process 200 may proceed to block 220. Otherwise, the process 200 may continue to execute block 215 until an appropriate user input is provided to one of the remote devices 110. In some instances, for example if a user input is not received within a certain amount of time, the process 200 may return to block 210 so that a reminder notification may be sent to the registered remote devices 110. This may occur a predetermined number of times or until one of the mobile devices 110 responds.

At block 220, the controller 135 may transmit an update signal to the non-responding remote devices 110. The update signal may be generated and transmitted in response to the controller 135 receiving the acknowledgement signal or otherwise determining that one of the remote devices 110 has responded to the notification signal. Thus, the update signal may indicate to the users of the non-responding remote devices 110 that the user of the responding remote device 110 has already responded to the notification signal and that no response from the non-responding remote devices 110 is necessary.

Figure 3:
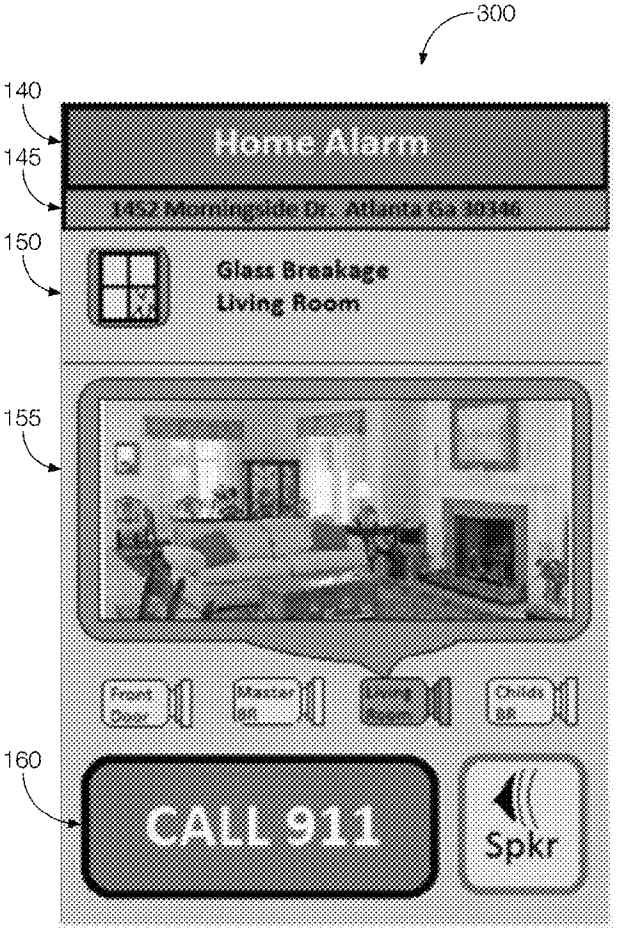
FIG. 3 illustrates an example graphical user interface for responding to an issue via a remote device.

FIG. 3 illustrates an example graphical user interface 300 for responding to an issue via a remote device 110. The interface 300 may include various fields or elements such as, e.g., an alert field 140, a location field 145, a status description field 150, a data display field 155, and an emergency call field 160. The alert field 140 may identify the nature of a potential emergency situation. The text in the alert field 140 may be based on the type of sensor 130 that has detected the potential emergency situation. For instance, the alert field 140 may include text such as "Home Alarm," "Smoke Alarm," "Water Damage," "HVAC Failure," etc. The location field 145 may indicate where the potential emergency situation has been identified. For instance, the location field 145 may include text such as "Living Room," "Master Bedroom," "Front Door," "Patio Door," "Basement," "Family Room," "Kitchen," "Garage Door," "Entry Door," etc. The status description field 150 may present text that describes the potential emergency situation identified in the alert field 140. For example, the status description field 150 may include text such as, e.g., "Glass Breakage—Living Room" or "Smoke Alarm—Kitchen." The data display field 155 may present media content or other data acquired by one or more sensors 130. For example, the data display field 155 may include a live video feed or still image captured by a camera located in the customer premises 105. Audio content may be played as well through a speaker or headphone jack in the remote device 110. Other example data that may be presented may include, e.g., an indication that smoke has been detected, a temperature captured by a smoke detector, an identification of which window triggered the glass-break sensor, etc. The emergency call field 160 may present a virtual button that can be used to enter the user input. For instance, the emergency call field 160 may include a button to call an emergency service provider 115. Alternatively or in addition, the emergency call field 160 may present a virtual button that confirms or denies the potential emergency situation. The user of the remote device 110 may be able to confirm or deny the potential emergency situation from the media content or other data presented in the data display field 155. Therefore, the emergency call field 160 may include a button indicating a user's desire for the potential emergency situation to be acted upon (by, e.g., dispatching an emergency service provider 115) or ignored. Pressing the button in the emergency call field 160 may cause the remote device 110 to transmit the acknowledgement signal to the controller 135. As discussed above, the controller 135 may transmit the update signal to the other, non-responding remote devices 110, in response to receiving the acknowledgement signal.

Figure 4:
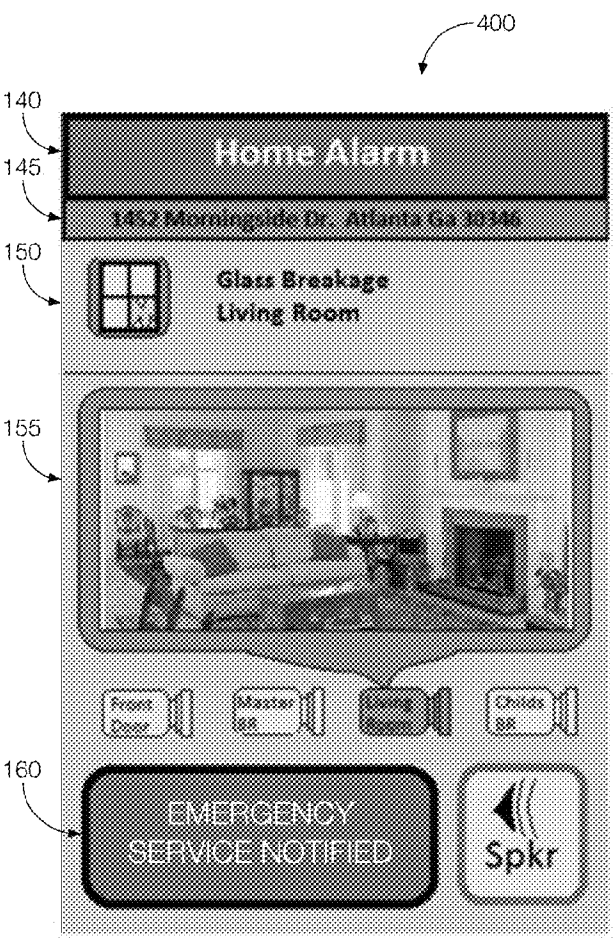
FIG. 4 illustrates an example graphical user interface for receiving via a remote device after one of the remote devices has responded to the notification signal.

FIG. 4 illustrates an example graphical user interface 400 for receiving via a remote device 110 after one of the remote devices 110 has responded to the notification signal. The interface 400 may include the same or different fields as those presented in the interface 300 illustrated in FIG. 3. When another remote device 110 has responded to the potential emergency situation, the emergency call field 160 of the non-responding remote devices 110 may be updated to indicate that no response is necessary. In some instances, the emergency call field 160 may identify which remote device 110 has already responded to the potential emergency situation and the nature of the response (e.g., making a call to an emergency service provider 115, transmitting an instruction to ignore the alert, etc.). The emergency call field 160 may be updated to provide such information in response to receiving, e.g., the update signal transmitted from the controller 135 to the non-responding remote devices 110.

Figure 5:
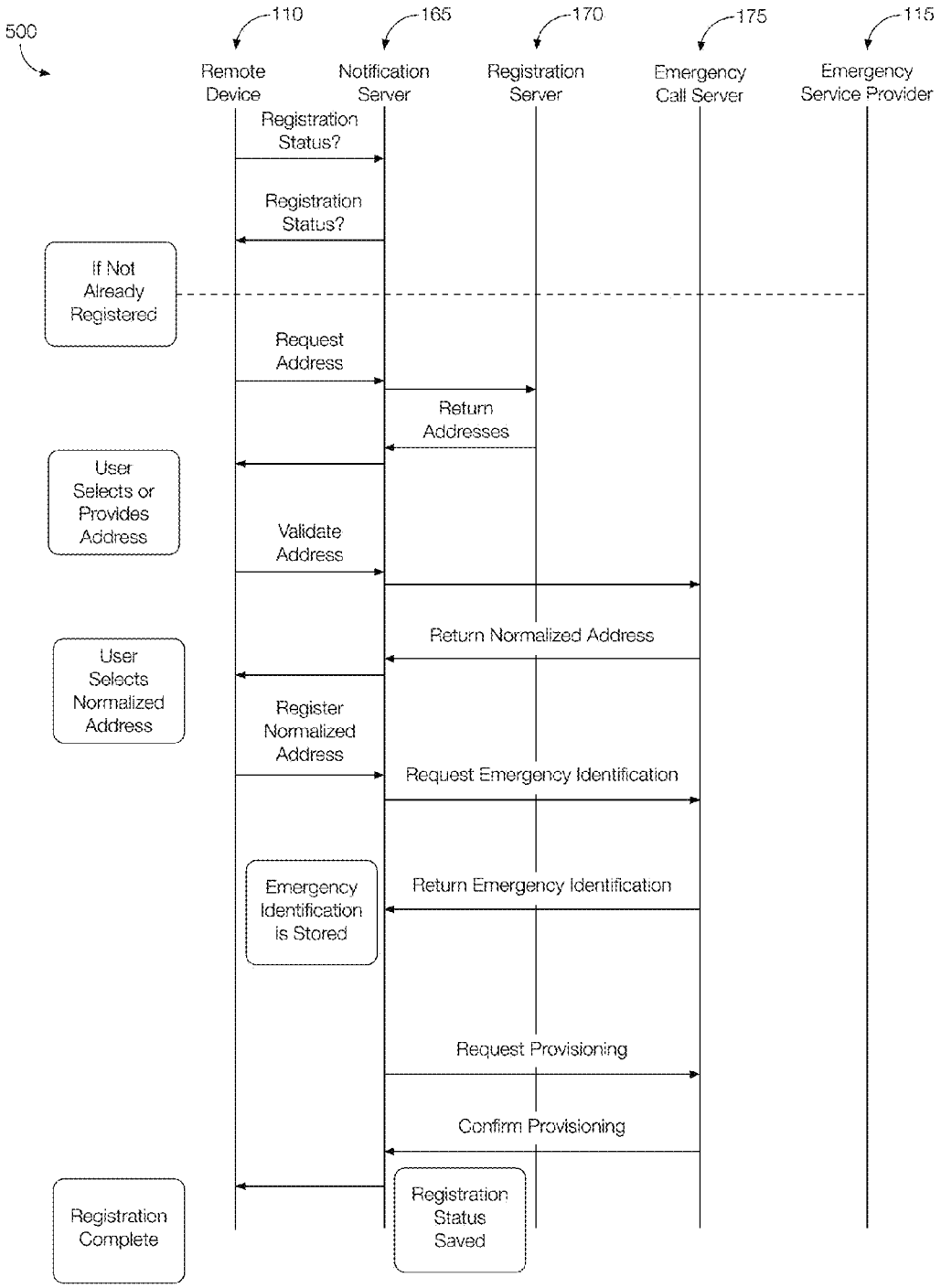
FIG. 5 illustrates an example sequence diagram for registering remote devices with a home automation service provider.

FIG. 5 illustrates an example sequence diagram 500 for registering remote devices 110 with a home automation service provider. The registration may occur via, e.g., an application executed on the remote device 110. As shown, the remote device 110 may transmit a message to a notification server 165. The message may request whether the remote device 110 is registered with the home automation system 100. The notification server 165 may respond with a registration status signal indicating whether the remote device 110 has already been registered. If the remote device 110 has not yet been registered, the registration status may include a request to provide additional information such as, e.g., a customer address. The remote device 110 may transmit the customer address to the notification server 165. The customer address may include an identification of the location of the customer premises 105. The notification server 165 may transmit the identification of the customer premises 105 to a registration server 170, and the registration server 170 may confirm and validate the address with both the notification server 165 and the remote device 110. In some instances, the remote device 110 may provide a "normalized" address to the notification server 165, the registration server 170, and a local emergency call server 175, which may confirm and validate the normalized address with the registration server 170, the notification server 165, and the remote device 110. When confirmed, the user of the remote device 110 may register the normalized address with the notification server 165, which may send a request for an emergency identification to the local emergency call server 175. The notification server 165 may store the emergency identification received form the local emergency call server 175. The notification server 165 may further request provisioning for the customer address, and registration may be completed following successful provisioning.

Figure 6:
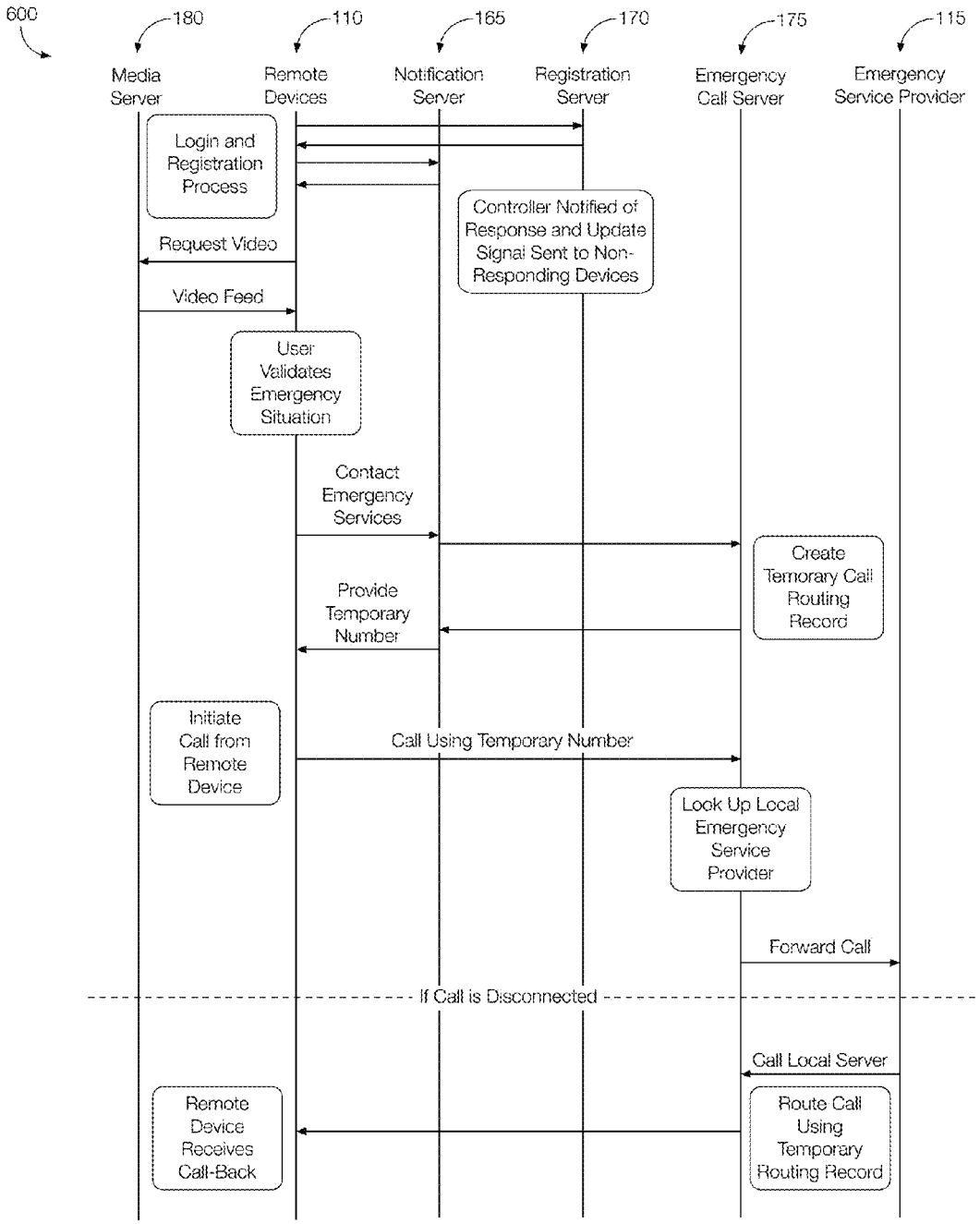
FIG. 6 illustrates an example sequence diagram for communicating the alert signal to multiple remote devices and notifying a subset of the remote devices after one remote device responds to the notification signal.

FIG. 6 illustrates an example sequence diagram for communicating the alert signal to multiple remote devices 110 and notifying a subset of the remote devices 110 after one remote device 110 responds to the notification signal. When a potential emergency situation is detected, the controller 135 may transmit an alert signal to the registered remote devices 110. In response to receiving the alert signal from the controller 135, the remote device 110 may log in to an application. The application may be the same or different application as was used to register the remote device 110. Logging in may include credentials being transmitted from the remote device 110 to the registration server 170 and from the remote device 110 to the notification server 165. The remote device 110 can request and receive a video stream or other media content from a media content server 180. In response, the media content server 180 may provide the requested media content to the remote device 110. The media content may be captured via one or more sensors 130, such as a camera, located at the customer premises 105. From the media content received from the media content server 180, the user may be able to confirm the potential emergency situation. If the user wishes to contact an emergency service provider 115, the remote device 110 may transmit a signal indicating as much to the notification server 165. The notification server 165 may transmit the signal to the local emergency call server 175, which may create a call routing record. The local emergency call server 175 may respond to the notification server 165 with a temporary number, which may be transmitted to the remote device 110. The remote device 110 may call the local emergency call server 175 using the temporary number. The local emergency call center may forward the call to a local (relative to the customer premises 105) emergency service provider 115. Should the remote device 110 be disconnected from the local emergency service provider 115, the local emergency service provider 115 may reestablish communication with the remote device 110 by calling the local emergency call server 175, which may forward the call to the remote device 110.

Further, when the remote device 110 logs in to respond to the potential emergency situation and either confirms or denies the potential emergency situation, the notification server 165 may generate and transmit a signal to the controller 135. In response, the controller 135 may transmit the update signal to the other, non-responding remote devices 110 registered with the customer premises 105.

By sending the alert signal to multiple remote devices 110, the home automation system 100 may increase the likelihood that at least one user can confirm the emergency situation before the police, fire department, or another emergency service is dispatched to the customer premises 105. Moreover, because the home automation system 100 sends the update signal after one of the users responds, the home automation service provider is less likely to receive multiple calls concerning the same emergency situation.

In general, the computing systems and/or devices described may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance. Examples of computing devices include, without limitation, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A system comprising:

a computing device programmed to receive an alert signal indicating an issue associated with a customer premises, transmit a notification signal to a plurality of remote devices including a first remote device and a second remote device, determine whether the first remote device responded to the notification signal, and transmit an update signal to the second remote device and not the first remote device after detecting that the first remote device responded to the notification signal, wherein the update signal indicates that the first remote device responded to the notification signal.

2. The system of claim 1, wherein the issue is associated with a potential emergency situation associated with the customer premises.

3. The system of claim 1, wherein the computing device is programmed to determine whether the first remote device responded to the notification signal based on a user input provided to the first remote device.

4. The system of claim 3, wherein the computing device is programmed to receive the user input, and wherein the user input includes an instruction to ignore the issue.

5. The system of claim 3, wherein the computing device is programmed to receive the user input, and wherein the user input includes an instruction to contact an emergency service provider to respond to the issue.

6. The system of claim 1, wherein each the plurality of remote devices is associated with the customer premises.

7. The system of claim 1, wherein the update signal is transmitted to the second remote device after the first remote device responds to the notification signal.

8. The system of claim 7, wherein the computing device is programmed to receive an acknowledgement signal indicating that the first remote device has responded to the notification.

9. The system of claim 8, wherein the computing device is programmed to generate and transmit the update signal after receiving the acknowledgement signal.

10. The system of claim 1, further comprising a sensor located at the customer premises and programmed to generate the alert signal.

11. The system of claim 10, wherein the sensor is programmed to detect the issue at the customer premises and generate the alert signal in response to detecting the issue.

12. The system of claim 11, wherein the sensor is programmed to wirelessly transmit the alert signal to the computing device, and wherein the computing device is programmed to wireless transmit the notification signal and the update signal.

13. The system of claim 10, wherein the sensor includes at least one of a camera, a motion sensor, a proximity sensor, a smoke detector, a glass-break sensor, and a carbon monoxide detector.

14. A system comprising:

a sensor programmed to generate an alert signal indicating an issue associated with a customer premises;

a computing device programmed to receive the alert signal, transmit a notification signal to a first remote device and a second remote device, determine whether the first remote device responded to the notification signal based at least in part on a user input received from the first remote device, and transmit an update signal to the second remote device and not the first remote device after the first remote device responds to the notification signal, wherein the update signal instructs the second remote device to present a message indicating that the first remote device responded to the notification signal.

15. The system of claim 14, wherein the issue is associated with a potential emergency situation associated with the customer premises.

16. The system of claim 14, wherein the computing device is programmed to receive the user input, and wherein the user input includes an instruction to ignore the issue.

17. The system of claim 14, wherein the computing device is programmed to receive the user input, and wherein the user input includes an instruction to contact an emergency service provider to respond to the issue, wherein the emergency service provider is associated with the customer premises.

18. The system of claim 14, wherein the computing device is programmed to receive an acknowledgement signal indicating that the first remote device responded to the notification and transmit the update signal to the second remote device after receiving the acknowledgement signal.

19. A method comprising:

receiving an alert signal indicating an issue associated with a customer premises;

transmitting a notification signal to a plurality of remote devices, including a first remote device and a second remote device;

determining that the first remote device responded to the notification signal; and transmitting an update signal to the second remote device, and not the first device, after determining that the first remote device responded to the notification signal, wherein the update signal instructs the second remote device to present a message indicating that the first remote device responded to the notification signal.

20. The method of claim 19, wherein determining that the first remote device responded to the notification signal includes receiving a user input from the first remote device, the user input including an instruction to ignore the issue or to contact an emergency service provider to respond to the issue.

* * * * *